United States Patent [19]

Werth et al.

[11] 4,447,103

[45] May 8, 1984

[54] MOISTURE SEAL FOR A SEPARABLE ELECTRICAL CONNECTION

[75] Inventors: Dee A. Werth, Afton; Lloyd G. Ratchford, Oneonta, both of N.Y.

[73] Assignee: The Bendix Corporation, Southfield, Mich.

[21] Appl. No.: 334,867

[22] Filed: Dec. 28, 1981

[51] Int. Cl.[3] ..... H01R 13/52

[52] U.S. Cl. ..... 339/94 M; 339/45 M

[58] Field of Search ..... 339/94 R, 94 A, 94 C, 339/94 L, 94 M, 126 R, 126 RS, 45 R, 45 M, 44 R, 44M, 46, 88–90; 285/45, 235, 302

[56] References Cited

U.S. PATENT DOCUMENTS

| | | | |
|---|---|---|---|
| 3,005,971 | 10/1961 | Lennox | 339/94 L |
| 3,049,690 | 4/1962 | Sparber | 339/45 R |
| 3,171,887 | 3/1965 | Cross et al. | 339/94 M |
| 3,544,952 | 12/1970 | Piaget | 339/94 R |
| 3,644,938 | 2/1972 | Slate | 339/91 R |
| 3,945,703 | 3/1976 | McCormick | 339/89 M |
| 4,286,834 | 9/1981 | Goodman et al. | 339/45 M |

*Primary Examiner*—Eugene F. Desmond
*Assistant Examiner*—David L. Pirlot
*Attorney, Agent, or Firm*—C. D. Lacina; R. J. Eifler

[57] ABSTRACT

Receptacle connector (10) secured by its flange (18) to panel (30) has a mating portion (14) extending forwardly from the panel for mating with mating portion (24) of plug connector (20) having a coupling member (40) rotatably mounted thereabout and adapted to draw the connectors together, an otherwise exposed region (50) about the mated connection being protected by a cup-shaped moisture seal (60) comprising a tubular body (62) sized to snugly fit about an exterior marginal annulus (41) of the coupling member and an annular flange (64) sized to fit about receptacle mating portion (14). Medial of annular flange (64) is a stiffening plate (70). An array of apertures of size sufficient to receive fasteners (68) pass through receptacle flange (18), annular flange (64), plate (70) and panel (30) annular flange (64) against flange (18) and panel (30) and moisture sealing thereabout.

6 Claims, 5 Drawing Figures

MOISTURE SEAL FOR A SEPARABLE ELECTRICAL CONNECTION

This invention relates to a moisture seal for a separable electrical connection and more particularly to a moisture seal for sealing from moisture and ice an otherwise exposed region locally about the mated portions of a pair of separable electrical connectors when one of the connectors is panel mounted.

One separable electrical interconnection comprises a receptacle connector, a plug connector, a coupling ring rotatably captivated on the plug connector and having on its interior wall thereof internal threads which are adapted to engage with exterior threads on the receptacle connector and a duality of contacts carried by the connectors for mating, rotation of the coupling ring drawing the connectors together and forming an electrical interconnection between the contacts. Contra-rotation of the coupling ring releases the connection so formed. In many applications, the receptacle connector includes a medial flange and is mounted therewith to a box or panel. Such a mounting arrangement fixes the connector end portions when mated and defines an exposed area subject to air and moisture penetration.

A "Releasing Electrical Connector" is shown in U.S. Pat. No. 4,279,458 issuing July 21, 1981 to Waldron et al. The "releasing" electrical connector comprises the above "standard" plug and receptacle connectors and a more complex "coupling ring". The "coupling ring" for releasing the electrical connection comprises the plug connector mounting therearound a segmented housing having a forward thread feature adapted to be cammed (i.e., "blossom") radially outward from coupling engagement with the receptacle thread, an operating sleeve circumposed therearound and adapted to be moved in a rearward direction relative to the mated forward ends of the connectors and several coil springs normally biasing the operating sleeve forwardly. In operation, a rearwardly directed force on the operating sleeve is transmitted through the plug to the receptacle, resulting in the operating sleeve moving rearwardly, the housing segments being cammed radially outwardly and the thread feature on each segment to disengage with the exterior thread on the receptacle connector. The thread disengagement allows the plug connector to release from the receptacle connector. Once mated, an annular air gap exists around the operating sleeve and the housing segments, between the individual segments and between the housing segments and receptacle thread. Unless otherwise protected these air gaps are subject to attack by air and moisture. Although separation may be achieved by contra-rotation of the "coupling member", the intended "release" function is that the operating sleeve move axially rearwardly about the plug and the segmented housings must blossom radially outward—in all environments.

Should moisture be received in the threaded front portion of the releasing connector and/or about the plug connector, electrical breakdown from moisture penetration is possible. In many environments, such as where both moisture and cold temperatures prevail, ice has a tendency to form. A current but severe ice resistance test required by a United States Military Specification (MIL-C-38999H) imposes a requirement that a connector operate at a minus 55° C. after immersed in water. If moisture is received in and freezes in the threaded forward mating end, the ice formation could present a relatively severe problem in that releasability could be prevented or alternatively increase the requisite amount of releasing force needed to break free of the frozen matter, a force sufficient to break the lanyard before release is accomplished.

Accordingly, a desirable electrical interconnection for standard connector parts of a separable electrical connector arrangement in ice and moisture prone environments would include a sealing arrangement which provides moisture sealing for one connector part, that easily adapts to presently available connectors and which effectively prevents moisture from entering the mated forward portions of the connectors bodies when mounted to a panel.

BRIEF DISCLOSURE OF THE INVENTION

A moisture seal is provided for a separable electrical connection of the type including a receptacle connector mounted by its flange to a panel and having its forward end extending from the panel and mated with the forward end of a plug connector and a coupling member carried by the plug connector. The moisture seal is characterized by a generally cylindrical, cup-shaped member integrally molded of a resilient rubber-like material and comprising an elongated tubular body having an annular body at a rearward end thereof, the annular body having a central opening slightly smaller than and sized to fit about the receptacle connector mating portion, the annular body being adapted to fit against the receptacle flange and be mounted therewith to the panel. Integrally molded within the annular body is a metal support member. The forward end portion of the tubular body is slightly chamfered and has a cross-sectional diameter slightly less than that of the coupling member so as to be configured to compressively squeeze about a marginal annulus of the coupling member. In one embodiment a plurality of aligned apertures extend through the annular body, the flange and the panel for receiving securement members such as threaded fasteners which compress the annular body against the panel. In another embodiment, a jam nut compresses about an inner face of the annular body to compress the seal against the panel. Mating of the plug connector with the receptacle connector causes the marginal annulus of the coupling member to move downwardly and into the interior of the tubular body, thereby causing the cylinder defining the tubular body to slightly compress in an axial direction, squeeze about the coupling member outer surface and the tubular body outer wall to deform radially outwardly. In either embodiment, a portion surrounding the connector threads is protected from moisture penetration and ice formation.

DETAILED DESCRIPTION OF THE INVENTION

Figure 1:
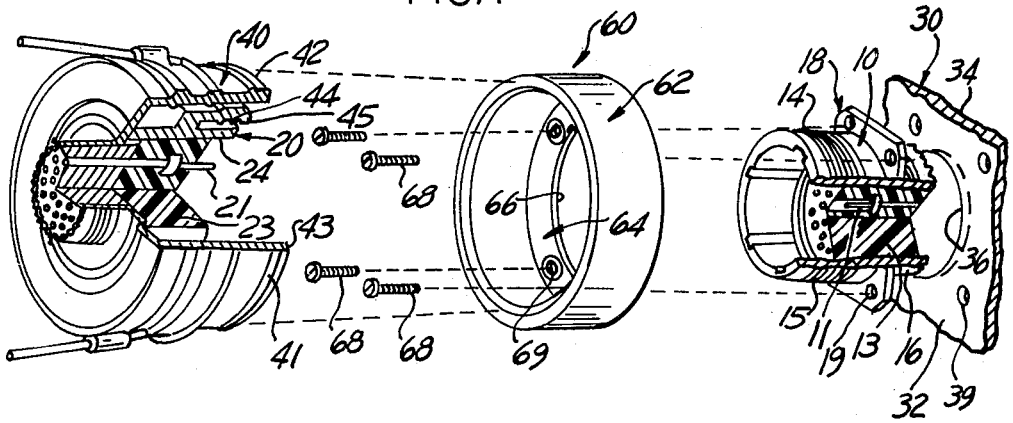
FIG. 1 shows, partially in section, a perspective view of a separable, moisture sealed, electrical connection according to the present invention.

Referring now to the drawings, FIG. 1 shows a first connector member (i.e., a receptacle shell) 10 having a mounting flange 18 and a forward mating end 14, a second connector member (i.e., a plug shell) 20 having a forward mating end 24, the plug mating end being sized to telescopically fit into the receptacle mating end, a socket-type contact 11 mounted in the receptacle connector member and adapted to mate with a pin-type contact 21 mounted in the plug connector member when the connectors are mated, dielectric inserts 13, 23 supported in the plug and receptacle shells respectively for mounting the pin and socket-type contacts, means 40 for releasably coupling the plug shell to the receptacle shell and a moisture seal 60 for preventing moisture from entering the connector members when the contacts are electrically interconnected (i.e., mated). The duality of pin and socket-type contacts for completing the electrical connection could be other than shown and the pin and socket contacts could be in either of the connectors.

A panel 30 for mounting the receptacle includes a front face 32, a back face 34 and an opening 36 extending between the faces.

Receptacle shell 10 includes a non-engaging end 16 rearwardly of flange 18 and threads 15 on the forward mating end 14. Receptacle connector 10 is mounted in panel 30 such that the receptacle non-engaging end 16 extends from front face 32 rearwardly and through opening 36, mounting flange 18 abutting front face 32 and forward mating end 14 extending outwardly from the panel for mating engagement with forward mating end 24 of plug shell 20.

The means 40 for releasably coupling plug shell 10 to receptacle 20 are as shown in the aforementioned U.S. Pat. No. 4,279,458 and, the specification and drawings of which being incorporated herein by reference, comprise a plurality of segmented housings 44 having a thread portion 45 thereon adapted to engage with receptacle shell thread 15, an operating sleeve 42 circumposed around plug shell 20 and segmented housings 44 and slidably disposed to cam the segmented housings radially outward from engagement with thread 15 on the receptacle shell and a plurality of springs 66 positioned in a housing 46 to bias operating sleeve 42 into its forward connected position. Operating sleeve 42 includes an exterior forward end portion or marginal annulus 41 of cylindrical shape and a generally transverse end face 43. Segmented housings 44 have an segment end face 47. When mated, an exposed area 50 (see FIG. 2) exists at the forward end of the releasing connector locally of the segmented housings and the operating sleeve as well as around the threads on the receptacle shell. Radially between operating sleeve 42 and segment end faces 47, around the receptacle shell and axially between the receptacle flange and the sleeve end segment end faces, ice and moisture could present a problem.

Preferably and in accord with this invention, a moisture seal 60 is provided. The moisture seal is formed of a resilient rubber-like elastomeric material into a generally cylindrical shape to define means for sealing about the marginal annulus 41 of operating sleeve 40 cylindrical exterior and for sealing about the mating end 24 of receptacle 20 when mounted in opening 36 of panel 30. Moisture seal 60 comprises a tubular body 62 having forward and rearward end sections with an annular body 64 being disposed at the rearward end section, the annular body 64 being adapted to be secured to panel 30 and having an internal opening 66 adapted to fit about the forward mating end 14 of receptacle shell 10. Tubular body 62 is sized at the forward end section thereof to have a cross-sectional diameter "D" less than that of the coupling member marginal annulus 41 so as to compressively fit about and cover an axial length of operating sleeve 40.

Means are provided for securing moisture seal 60 to panel 30 and comprise flange 18 of receptacle shell 10 having an array of apertures 19, panel 30 having an array of apertures 39 and annular body 64 having an array of apertures 69, each of the aperture arrays being configured to be in register with one another to receive a plurality of heeded fasteners 68 when aligned. The fasteners, when secured by nuts 68*a*, cooperate to compress and squeeze annular body 64 about receptacle flange 18.

Figure 2:
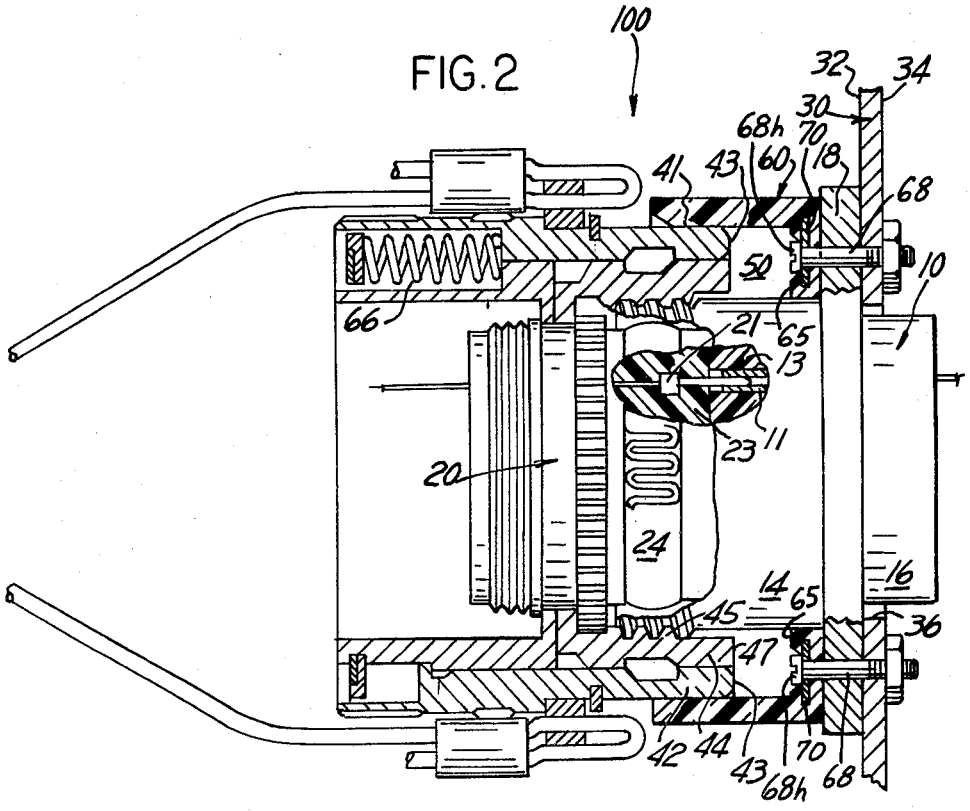
FIG. 2 shows, in section, the moisture sealed electrical connection of FIG. 1.

FIG. 2 shows, in cross-section, a moisture sealed electrical connection 100, the connection comprising the receptacle shell 10 being mounted against front face 32 of panel 30 and the plug connector 20 (part of the releasing electrical connector) with moisture seal 60 in place and protecting exposed area 50 from ice and moisture penetration.

Figure 3:
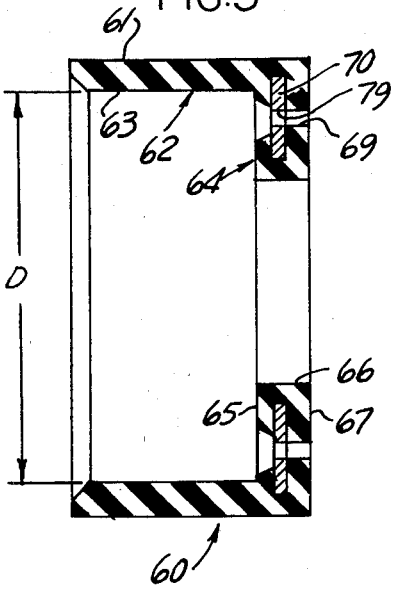
FIG. 3 is a sectional view of a moisture seal of FIGS. 1 and 2.

FIG. 3 shows moisture seal 60 in section. The moisture seal is generally cylindrical, concentric and cuped-shaped. Tubular body 62 is generally of uniform thickness as defined by inner and outer walls 61, 63 and provides a protective cavity for receiving the coupling member, the cavity having cross-sectional internal diameter "D" which is less than the outer diameter of the coupling member. In one embodiment a wall thickness of 0.250 inches (0.63 cm) was found suitable. Annular body 64 is integrally formed at the rear end section of tubular body 62, includes forward and rearward axial faces 65, 67 and defines therewith a radially inwardly directed flange having disposed between its axial faces the annular opening 66 for fitting around the receptacle shell forward mating end 14. The forward end section of tubular body 62 is slightly chamfered (i.e., tapered radially inwardly) so as to permit a smooth guided entry of the marginal annulus 41 of the coupling member (i.e., operating sleeve 40) during mating with the receptacle shell. For a coupling member having an exterior diameter of 1.5 (3.81 cm.) inches, axially sealing about a marginal annulus of 0.250–0.375 inches (0.63–0.95 cm.) is suitable.

For resisting seal deformation/destruction, to stiffen the seal to provide seal support and to enhance sealing about the flange/panel, a rigid support member 70 is embedded within the elastomer of annular body 64. Preferably and in accord with this invention a metallic disc is utilized. This disc is medially disposed in and between the forward and rearward axial faces 65, 67 and provided with an array of apertures 79 which are configured to register with the array of apertures disposed in the sealing member, apertures 79 being adapted to pass fastening members 68 therethrough and through the apertures 39 in panel 30 for engagement by nuts 68*a* behind the panel. Further, the circumference of metallic disc 70 is not radially coextensive with outer wall 61 or of opening 66 of annular body 64.

Figure 4:
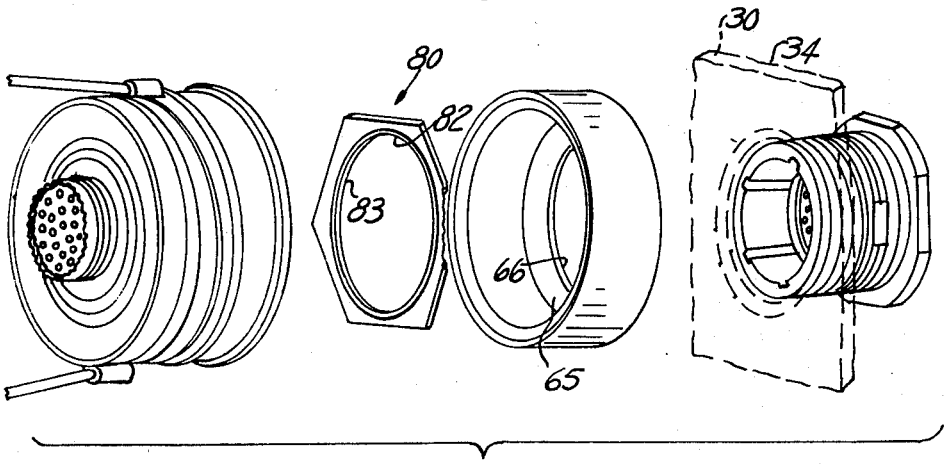
FIG. 4 shows a perspective view of an alternate embodiment of a moisture sealed electrical connection according to the invention.

FIG. 4 is an alternate embodiment of this invention and shows receptacle shell 10 being mounted in panel 30 so that receptacle flange 18 abuts against backface 34 and mating end 14 extends through opening 36 and outwardly from front face 32 for mating. A fastener jam nut 80 having a hexagonal shape includes an opening 82 provided with thread 83 for engaging exterior thread 15 on receptacle shell 10 such that when the jam nut is concentrically screwed inwardly and about the receptacle mating end and downwardly about (inner) forward axial face 65 of annular body 64, the moisture seal 60 is secured to panel 30 and forms a moisture seal therewith.

Figure 5:
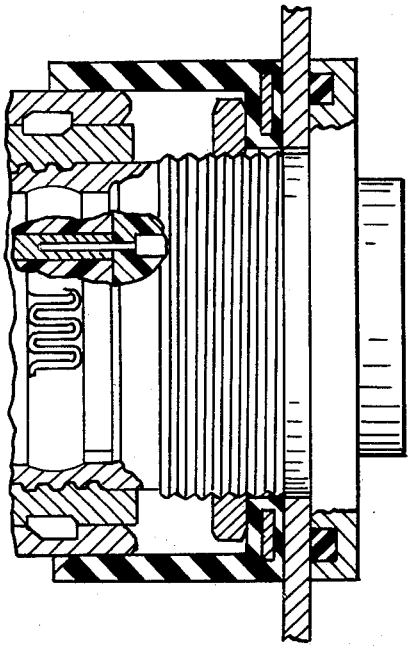
FIG. 5 shows, partially in fragmented section, the moisture sealed electrical connection of FIG. 4.

FIG. 5 shows in cross-section the moisture sealed electrical connection wherein the receptacle flange is mounted against the panel back face, the receptacle mating end extends through the panel opening 36 and forwardly of the panel front face 32 and the releasing electrical connector is mated to the receptacle, the moisture seal 60 being compressed against the panel front face 32 by fastener jam nut 80 and protecting exposed area 50 from ice and moisture penetration.

Preferably and in accord with this invention the elastomer should not be too weak nor too strong. An elastomer having a durometer between 55 to 75 would be suitable with durometer 70 being preferred.

Operation

Receptacle connector shell 10 is inserted into opening 66 of the panel. The fasteners are tightened against seal annular body 64 to form a moisture seal between the connector flange and the panel face. Plug connector 20 is coupled with the receptacle connector 10, causing operating sleeve 40 to enter within the chamfered opening of seal member 60 and be compressively fit within tubular body 62. Further coupling therebetween draws the operating sleeve towards panel 30, causing the rubber wall of tubular body 62 to slightly compress in the axial direction and be deformed radially outwardly. The slight rearward axial motion of the cylinder causes the rubber wall to form a water tight squeezing fitment about marginal annulus 41 on the outer wall of operating sleeve 40 and prevent moisture from entering the forward end portion of the mated assembly and the securement of the seal about the receptacle mounted on the panel prevents moisture from entering from the panel end.

In either embodiment, annular body 64 functions to seal the panel in much the same way, the seal member having been secured to the wall either by the headed fasteners or by the jam nut compressively squeezing there against.

While a preferred embodiment of this invention has been disclosed, it will be apparent to those skilled in the art that changes be made to the invention as set forth in the appended claims, and in some instances certain features of the invention may be used to advantage without corresponding use of other features.

For example, whereas the cylindrical wall of tubular body 62 of seal member 60 is shown being of generally uniform thickness, it is to be understood that seal 60 could have a tapering and outwardly expanding cross-section from the forward end to the rearward end of the cylinder to provide improved resistance to collapse and eliminate local ripple-like buckling about the marginal annulus of the coupling member.

We claim:

1. A moisture seal for a separable electrical connection mounted on a panel (30), said connection comprising first and second electrical connectors (20, 10) having respective forward portions (24, 14) and contacts (21, 11) interconnected, said second electrical connector (10) having a flange portion (18) secured to the front face of the panel (30); and means (40, 42, 44, 46, 45, 15) for releasing the interconnected forward portions, the releasing means comprising a sleeve (42) having a marginal annulus (41) therearound and a transverse end face (43) confronting the flange portion (18), said moisture seal being adapted to seal a region (50) locally around and between the marginal annulus (41) and said flange portion (18), said moisture seal characterized by:

a resilient elastomer (60) comprising a tubular section (62) having an annular section (64) connected thereto, said tubular section (62) having an internal diameter (D) slightly less than said sleeve (42) and sized to radially squeeze about the marginal annulus (41), said annular section (64) including an axial face (65), a molded-in support member (70) and an opening (66) slightly smaller than and sized to radially squeeze about the second mating portion (14); and means for securing said annular section (62) to said panel (30), said securing means comprising a plurality of tightenable headed fastener members (68) and an array of apertures (69, 79, 19, 39) passing, respectively, through said annular section (64), said support member (70), said flange portion (18) and said panel (30), each said array of apertures being aligned with one another and sized to receive a fastener member (68) therethrough, the array of apertures (69) through the annular section (64) being chamfered inwardly from said axial face (65) to intersect with and allow the fastener head to abut against the support members (70) whereby tightening the fastener member against the support member (70) compresses the annular section (64) against the panel.

2. The invention as recited in claim 1 wherein said moisture seal is integrally molded and forms a one-piece cup-shaped member.

3. The invention as recited in claim 2 wherein the support member (70) is an annular disc formed of a metal having an outer diameter less than the outer diameter of either the annular section (64) or of the tubular section (62).

4. The invention as recited in claim 2 wherein said tubular section (64) has substantially uniform wall thickness and is provided at a forward end thereof with an inward chamfer.

5. A separable electrical connector of the type comprising a first connector member (10) mounted in a panel (30) and a second connector member (20), the first connector member (10) having a forward end portion (14) extending from the panel (30) for mating with a forward end portion (24) of the second connector member (20); means (40, 42, 44, 46, 45, 15) for releasably coupling said connector members in their mated condition including a coupling sleeve (42) having a forward marginal annulus (41) and a seal for protecting the mated connectors from moisture, the seal characterized by:

an elastomeric member (60) of resilient material and comprising a tubular body (62) having forward and rearward end sections, the rearward end section including a radially inwardly directed annular flange (64) having an opening (66) sized to fit snugly around the forward end portion (14) of the first connector member (10) and the forward end section being sized to fit snugly about the marginal annulus (41) of the coupling sleeve (42);

a rigid member (70) for stiffening the annular flange (64); and means for securing the elastomeric member (60) to the panel (30), said securing means comprising an array of apertures (69, 79, 39) passing through the annular flange (64), the rigid member (70) and the panel (30) with each said array of apertures being aligned with one another and adapted to receive a headed fastener member (68, 68*a*) therethrough, the array of apertures (69) on the annular flange (64) being chamfered inwardly to intersect the rigid member (70) to allow the fastener head to abut thereagainst and compress the annular section (64) against the panel.

6. A moisture seal for a panel mounted connection of the type including a first electrical connector (10) having a flange portion (18) secured to the panel (30) and a first mating portion (14) extending from the panel, a second electrical connector (20) having a mating portion (24) interconnected with the first mating portion (14); a duality of interconnected electrical contacts (11, 21) carried by said electrical connectors; and means (40, 42, 44, 46, 45, 15) for releasably coupling the connectors, the coupling means comprising a sleeve (42) having a marginal annulus (41) therearound and a transverse end face (43) confronting the flange portion (18), said moisture seal being adapted to seal a region (50) locally around and between the marginal annulus (41) and the flange portion (18), said moisture seal characterized by:

said panel (30) including a front face (32), a back face (34) and a hole (36) extending between the faces, said first electrical connector (10) being secured so as to have its flange portion (18) abutting against the back face (34) and its forward mating portion (14) extending through the hole (36) and terminating fowardly of the front face (32);

a resilient elastomer (60) comprising a tubular section (62) including an annular section (64) connected thereto, the tubular section (62) having an internal diameter (D) slightly less than the sleeve and defining a cavity sized to radially squeeze about the marginal annulus (41), the annular section (64) including an opening (66) slightly smaller than and sized to radially squeeze about the first mating portion (14); and means for securing the annular section (62) to said panel (30), said securing means comprising a threaded jam-nut (80) sized to threadably engage the second mating portion (14) and compress the annular section (64) downwardly about front face (32) of said panel (30).

* * * * *